United States Patent [19]

Bach et al.

[11] 4,293,613

[45] Oct. 6, 1981

[54] ACRYLIC FIBER HAVING IMPROVED BASIC DYEABILITY

[75] Inventors: Hartwig C. Bach; Helmuth E. Hinderer, both of Pensacola, Fla.

[73] Assignee: Monsanto Company, St. Louis, Mo.

[21] Appl. No.: 157,129

[22] Filed: Jun. 6, 1980

[51] Int. Cl.[3] ..... D02G 3/00

[52] U.S. Cl. ..... 428/364; 8/115.5; 8/927; 260/DIG. 23; 260/DIG. 32; 428/373; 428/374

[58] Field of Search ..... 428/364, 373, 374, 372; 260/DIG. 32, DIG. 23; 525/193, 238; 8/115.5, 927

[56] References Cited

U.S. PATENT DOCUMENTS

| | | | |
|---|---|---|---|
| 3,088,188 | 5/1963 | Knudsen | 428/373 X |
| 3,607,611 | 9/1971 | Matsui et al. | 428/374 |
| 3,963,790 | 6/1976 | Couchoud | 260/DIG. 32 |
| 4,081,498 | 3/1978 | Maranci | 260/DIG. 32 |

FOREIGN PATENT DOCUMENTS

| | | | |
|---|---|---|---|
| 974719 | 9/1975 | Canada | 428/373 |

*Primary Examiner*—Lorraine T. Kendell

*Attorney, Agent, or Firm*—Robert L. Broad, Jr.; John W. Whisler

[57] ABSTRACT

Disclosed is an acrylic fiber having improved basic dyeability. The fiber is made by a process wherein a copolymer of an acrylic monomer and a sulfonated vinyl monomer is dissolved in a solvent to form a spinning dope and a solution of polystyrene in the same solvent is added to the dope prior to spinning the dope to form fibers. The polystyrene will be in the form of a separate phase dispersed throughout the spinning dope and the fibers formed from the dope. Fibers formed from this polystyrene-containing dope have improved basic dyeability.

5 Claims, No Drawings

ACRYLIC FIBER HAVING IMPROVED BASIC DYEABILITY

BACKGROUND OF THE INVENTION a. Field of the Invention

This invention relates to acrylic fibers having improved basic dyeability.

b. Description of the Prior Art

It is known to use additives such as vinyl benzene sulfonate as copolymers in making acrylic fibers, the vinyl benzene sulfonate being used to enhance the basic dyeability of the acrylic fibers by providing dye sites. One of the disadvantages of this approach is that these additive monomers are usually expensive. Further, it is very difficult to recover the unreacted portions of monomers of this type. In the past these unreacted monomers have been sewered but this has a double disadvantage in that an expensive monomer is lost and that monomer is non-biodegradable. It would be very desirable to use less of this sulfonated monomer and yet achieve the same or improved basic dyeability.

It is known to use small amounts of styrene as a monomer in making acrylic fibers, the styrene being added to serve as a plasticizer. The styrene is incorporated as a monomer and is copolymerized with the acrylic monomer so as to be an integral part of the polymeric chain. Use of styrene in this manner does not appear to give any improvement in basic dyeability.

SUMMARY OF THE INVENTION

An acrylic fiber having polystyrene dispersed therethrough as a separate phase has an improved basic dyeability. The fiber is made by a process wherein a copolymer of an acrylic monomer and a sulfonated vinyl monomer is dissolved in a solvent to form a spinning dope and a solution of polystyrene or its copolymers in the same solvent is added to the dope prior to spinning the fibers. The polystyrene will be in the form of a separate phase dispersed throughout the spinning dope. Fibers formed from this spinning dope or solution have improved basic dyeability. Less of the expensive sulfonated monomer can be used to achieve the desired basic dyeability when the polystyrene is used. At least some of the sulfonated monomer must be used, for the reason that the polystyrene is ineffective when such monomer is not present.

DETAILED DESCRIPTION OF THE INVENTION

In this invention a solution of polystyrene in a solvent is added to a spinning dope made of an acrylic polymer dissolved in the same solvent. The acrylic polymer is made by copolymerizing an acrylic monomer with a sulfonated vinyl monomer and may be blended with another acrylic polymer containing no sulfonated vinyl monomer. After the solution of polystyrene is added to the spinning dope, the dope is extruded in a conventional manner to form acrylic fibers which have an improved basic dyeability.

The polystyrene is present in the spinning dope and in the spun fiber as a separate, discrete phase and is uniformly dispersed throughout the dope and the fiber.

The reason for the improvement in basic dyeability is not fully understood. Increased dyeability is not traceable to a more porous fiber structure of greater surface area, since the fibers of this invention have a more dense structure and a smoother surface than fibers not containing the polystyrene. It is believed that the improvement in dyeability achieved by this invention is a result of partially disrupting, in some manner, the acrylic fiber morphology, thereby making the dyesites more accessible.

The addition of the polystyrene is effective only when the acrylic polymer contains a sulfonated vinyl monomer. If no sulfonated vinyl monomer is present as part of the acrylic polymer, the result achieved by adding polystyrene as described herein ranges from ineffective to detrimental, as far as dyeability is concerned.

In examples set out below the various polymers have the following compositions, by weight.

| Polymer | Composition |
|---|---|
| A | 93% acrylonitrile (An)<br>7% vinyl acetate (VA) |
| B | 84% acrylonitrile<br>6% vinyl bromide (VBr)<br>10% sodium sulfophenyl methally ether (SPME) |
| C | 87.2% acrylonitrile<br>6.9% vinyl acetate<br>5.9% vinyl bromide |
| D | Blend of 85% polymer A and 15% polymer B. |

POLYMER BLENDING

The polystyrene-containing polymer blends of this invention were typically prepared as follows. A three liter resin kettle equipped with a helical stainless steel stirrer, a drying tube and stoppers was charged with dimethylacetamide and one of the above acrylic polymers with polymer B, the amounts of each being sufficient to give the specified percentages (refer to Tables below) of the polymers in sufficient dimethylacetamide to give a solution containing about 20% polymer by weight. The mixture was stirred overnight at room temperature to give a pale yellow, clear dope. A 20% polystyrene (PS) dope was prepared in a 1 liter resin kettle equipped as described above, using 200 g of PS and 800 g of DMAC with heating at about 70° C. A sufficient amount of this polystyrene-containing solution was added to the polymer blend described above to give the specified percentage of polystyrene and the resultant turbid spin dope was stirred at ambient temperature overnight.

Polymer D, a blend of polymers A and B, was also prepared in a 3 liter resin kettle arranged as described above for use, without polystyrene, as a comparison or control. The kettle was charged with 2240 g of DMAC which was then chilled to about 0° C. There was then added 476 g of acrylic polymer A and 84 g of acrylic polymer B. The kettle was removed from the cooling bath and the mixture was stirred at ambient temperature for one hour and then at 60° C. in an oil bath for four hours to give a clear, pale yellow dope. This is the polymer used as a control or comparison in Examples II, IV, VI, VIII, X and XII.

The acrylic polymers useful in forming the fibers of this invention are made up of, by weight, at least about 35% acrylonitrile, 1 to 20% of a sulfonated vinyl monomer, and the balance of another mono-olefinic monomer copolymerizable with acrylonitrile. These mono-olefinic monomers are well known to those skilled in the art. Vinyl acetate, vinyl bromide and vinylidene chloride are examples. Preferably, the acrylic polymer contains at least about 85% acrylonitrile.

The sulfonated vinyl monomer may be present as a component of a single acrylic polymer or may be present as a copolymer of one acrylic polymer which is blended with another polymer, as where polymers A and B are blended together.

Sulfonated vinyl monomers copolymerizable with acrylonitrile are well known to those skilled in the art. Examples are vinyl benzene sulfonate and sodium sulfophenyl methallyl ether, the latter being preferred in this invention. The fiber should contain about 1–20 weight percent of the sulfonated monomer.

FIBER SPINNING

Fibers were formed by blending various polymers as described above in sufficient dimethylacetamide to form a spinning solution containing about 20 weight percent of polymer and then forming fibers by a conventional wet spinning process. The fibers were extruded through a spinnerette having 25 spinning orfices of 3 mils each into a spin bath made up of 57 weight percent dimethylacetamide and 43 weight percent water at a temperature of about 38° C. After spinning, the fibers were passed through a boiling water cascade to remove the dimethylacetamide while being hot stretched 6×. The fibers were again washed in water at about 95° C., passed through a finish applicator and then dried on steam heated dryer rolls held at 115° C. Basic dye uptake (BDU) and other properties of the fibers were determined using conventional methods.

The polystyrene, which will have a molecular weight of about 50,000 to 100,000, is dissolved in dimethylacetamide at about 70° C. to form a solution which is mixed with the spinning solution prior to fiber formation. The polystyrene polymer will be in the form of a discrete phase dispersed through the spinning solution or dope and the fibers formed from the solution.

Fibers formed from various combinations of the polymers described above had the properties shown in Table 1. This table will show that the control fibers of Examples II, IV and VI, containing no polystyrene had lower basic dye uptake values. Also, a comparison of Examples II and VII shows that the inclusion of a small amount of polystyrene allows a reduction in the amount of polymer B, which contains the most expensive sulfonated monomer, and yet improves BDU.

TABLE I

| Example | Polymer Blend | Tenacity g/d | Elongation % | Initial Modulus g/d | dpf | BDU % |
|---|---|---|---|---|---|---|
| I | 80%A 20%B 5%PS | 2.5 | 11.3 | 68 | 2.4 | 18.9 |
| II | 85%A 15%B (Control) | 2.8 | 11.5 | 76 | 2.5 | 14.4 |
| III | 80%A 15%B 5%PS | 2.7 | 11.5 | 66 | 3.2 | 16.2 |
| IV | 85%A 15%B (Control) | 2.9 | 14.0 | 68 | 2.8 | 12.9 |

TABLE I-continued

| Example | Polymer Blend | Tenacity g/d | Elongation % | Initial Modulus g/d | dpf | BDU % |
|---|---|---|---|---|---|---|
| V | 80%C 15%B 5%PS | 2.5 | 11.6 | 65 | 2.5 | 16.5 |
| VI | 85%C 15%B (Control) | 3.0 | 14.2 | 63 | 2.5 | 14.3 |
| VII | 85%A 10%B 5%PS | 2.6 | 8.1 | 92 | 1.3 | 17.7 |

Table 2 shows BDU in terms of dyeing time, Examples VII, X and XII being control or comparison examples and containing no PS.

BASIC DYE UPTAKE VS. TIME

| Example | Polymer Blend | Weight of Sample (g) | Dyeing Time (Min) | Transmittance at 635 nm (%) Sample | Transmittance at 635 nm (%) Blank | BDU (%) |
|---|---|---|---|---|---|---|
| VIII | Acrylic A/Acrylic B (85/15) | 0.5082 | 15 | 59.8 | 49.5 | 5.3 |
| IX | A/PS/B (80/5/15) | 0.5024 | 15 | 64.3 | 48.6 | 7.9 |
| X | A/B (85/15) | 0.4991 | 30 | 65.5 | 49.8 | 7.8 |
| XI | A/PS/B (80/5/15) | 0.5031 | 30 | 77.8 | 48.5 | 13.3 |
| XII | A/B (85/15) | 0.5025 | 120 | 82.0 | 49.1 | 14.4 |
| XIII | A/PS/B (80/5/15) | 0.5023 | 120 | 96.2 | 49.1 | 18.9 |

A copolymer of a major portion of styrene and a minor portion acrylonitrile may be used to enhance basic dyeability of acrylic fibers. A blend was formed of 80 weight percent of polymer A, 15 weight percent of polymer B and 5 weight percent of a copolymer of 73% styrene and 27% acrylonitrile. After spinning, washing and stretching as described above, the fibers had a tenacity of 5.5 gpd, an elongation of 7.5% and a BDU of 22.3%.

In the method disclosed above the acrylic polymer and the additive polymer are dissolved separately. It should be understood that both polymers may be dissolved together.

What is claimed is:

1. An acrylic fiber having improved basic dyeability, said fiber being formed from a blend of a. an acrylic polymer containing at least about 35 weight percent acylonitrile and 1 to 20 weight percent of a sulfonated vinyl monomer, said sulfonated vinyl monomer being polymerized with said acrylonitrile, and b. 1–20 weight percent of polystyrene, said polystyrene being present in the form of a separate phase dispersed throughout the fiber.

2. The fiber of claim 1 wherein said acrylic polymer is a blend made up of a. a first polymer of at least about 85 weight percent of acrylonitrile copolymerized with up to about 15 weight percent of another monoolefinic monomer, and b. a second polymer of at least about 80 weight percent of acrylonitrile copolymerized with about 1 to 20 weight percent of a sulfonated vinyl monomer.

3. The fiber of claim 2 wherein the sulfonated monomer is sodium sulfophenyl methallyl ether.

4. The fiber of claim 3 wherein the polystyrene has a molecular weight within the range of 50,000 to 100,000.

5. The fiber of claim 4 wherein the polystyrene is a copolymer of a major portion of styrene and a minor portion of acrylonitrile.

* * * * *